US006662516B2

(12) United States Patent
Vandehey et al.

(10) Patent No.: US 6,662,516 B2
(45) Date of Patent: Dec. 16, 2003

(54) REINFORCED WALL STRUCTURES AND METHODS

(75) Inventors: Ronald G. Vandehey, Aloha, OR (US); Raymond T. Miller, Lake Oswego, OR (US); Roger W. Tikka, Brush Praire, WA (US)

(73) Assignee: Seismic Rehab, LLC, Portland, OR (US)

( * ) Notice: Subject to any disclaimer, the term of this patent is extended or adjusted under 35 U.S.C. 154(b) by 70 days.

(21) Appl. No.: 09/990,907

(22) Filed: Nov. 16, 2001

(65) Prior Publication Data

US 2002/0108347 A1 Aug. 15, 2002

Related U.S. Application Data

(63) Continuation-in-part of application No. 09/781,933, filed on Feb. 12, 2001.

(51) Int. Cl.[7] ..... E04B 1/74

(52) U.S. Cl. ..... 52/407.1; 52/742.13; 52/309.5; 52/506.9; 52/508; 52/506.06

(58) Field of Search ..... 52/742.1, 742.13, 52/742.14, 437, 439, 309.4, 309.5, 404.1, 407.1, 425, 426, 506.06, 508, 506.01

(56) References Cited

U.S. PATENT DOCUMENTS

| | | | | |
|---|---|---|---|---|
| 3,315,424 A | | 4/1967 | Smith | |
| 3,893,275 A | | 7/1975 | Omholt | |
| 4,027,846 A | | 6/1977 | Caplat | |
| 4,103,464 A | * | 8/1978 | Clifft et al. | 52/127.4 |
| 4,263,759 A | | 4/1981 | Miller | |

(List continued on next page.)

FOREIGN PATENT DOCUMENTS

| | | |
|---|---|---|
| GB | 1599033 | 9/1981 |
| GB | 2136042 A | 9/1984 |

OTHER PUBLICATIONS

El–Zeiny, A. et al., "Seismic Evaluation of the Performance of Retrofitted and Repaired Brick Walls by Means of Expansive Epoxy Injection," California State University, Fresno, Department of Civil & Geomatics Engineering & Construction, Aug. 2000.

"Report on Prototype Testing of Repair Techniques for Repair of Earthquake Damage to Los Angeles City Hall Exterior Walls under Contract DACW09–72–0067," prepared by VTN Orange County, May 12, 1972.

Prior to Feb. 12, 2000, foamable polyurethane was used commercially in a retrofit of a structure having two, spaced apart brick walls. In this application, polyurethane was used to fill the space between the two brick walls without forming multiple layers.

*Primary Examiner*—Carl D. Friedman
*Assistant Examiner*—Chi Q. Nguyen
(74) *Attorney, Agent, or Firm*—Klarquist Sparkman LLP

(57) ABSTRACT

Reinforced wall structures and methods for strengthening wall structures to more effectively resist damage produced by seismically induced forces are disclosed. According to one embodiment, a method for strengthening a double wall structure comprises forming plural layers of a foamable, adhesive material in the cavity between the two wall portions of the double wall structure to bond together the wall portions. According to another embodiment, a method for strengthening a single wall comprises spacing a sheathing layer from one surface of the wall so as to define a cavity therebetween. A plurality of structural members are positioned outside of the cavity so as to support the inner form. A foamable, adhesive material is introduced into the cavity to bond together the inner form and the wall.

45 Claims, 4 Drawing Sheets

U.S. PATENT DOCUMENTS 4,272,935 A 6/1981 Lukas et al.
4,288,962 A 9/1981 Kavanaugh
4,342,181 A 8/1982 Truesdell
4,563,852 A * 1/1986 Achtenberg et al. ..... 52/742.14
4,606,169 A 8/1986 Noon et al.
4,671,032 A 6/1987 Reynolds
5,273,693 A 12/1993 Rothwell et al.
5,459,970 A * 10/1995 Kim ..... 52/424
5,655,350 A 8/1997 Patton
5,709,058 A 1/1998 Shaw
5,725,327 A 3/1998 Hussey et al.
5,765,330 A * 6/1998 Richard ..... 52/309.13
5,816,008 A * 10/1998 Hohmann ..... 52/565
5,833,873 A * 11/1998 Adonetti ..... 249/47
5,921,055 A * 7/1999 Romes et al. ..... 52/742.13
6,003,276 A 12/1999 Hegemier et al.
6,047,518 A 4/2000 Lytle
6,105,335 A * 8/2000 Vohra ..... 52/741.41
6,226,942 B1 * 5/2001 Bonin ..... 52/309.12
6,240,691 B1 * 6/2001 Holzkaemper et al. ..... 52/315
6,389,758 B1 * 5/2002 Martin, Jr. ..... 52/125.2
6,430,889 B1 * 8/2002 Nixon, Sr. ..... 52/656.4

* cited by examiner

REINFORCED WALL STRUCTURES AND METHODS

CROSS REFERENCE TO RELATED APPLICATION

This application is a continuation-in-part of patent application Ser. No. 09/781,933, filed Feb. 12, 2001.

FIELD

The present invention relates to methods for providing structural reinforcement to preexisting wall structures using an adhesive material.

BACKGROUND

There are countless older buildings located in earthquake-prone regions of the world whose walls are susceptible to seismically induced damage. During an earthquake, the ground upon which the building rests moves laterally and/or vertically. These ground motions are transmitted through the building foundation to the building walls. The walls may crack as a result of the ground motions or, if the motions are sufficiently severe, the walls may fail completely and collapse. Damage caused by seismically induced forces is exacerbated in buildings with walls made from weak or brittle materials, such as clay tile, which are susceptible to failure even in the event of a relatively minor earthquake.

Accordingly, it is desirable to reinforce such building walls with bracing to resist the forces created by seismic activity. A common method for retrofitting a preexisting wall structure 6 is illustrated in FIG. 1. In this method, metal studs 12 are secured to the outside surface of each wall portion 8 of the double wall structure 6. The studs 12 extend vertically in a parallel array and are securely mounted to the outside surface of each wall portion 8 with suitable masonry ties 14, such as Helifix screws. An outer wall 16 may be mounted to the metal studs 12 to provide a conventional wall surface and hide the studs.

Although this method is adequate for its intended purpose, that is, for strengthening the wall structure to resist seismic forces, it is a costly and labor-intensive process. Moreover, stud walls added to the inside walls of a building can be intrusive and reduce usable space. In the case of a school, for example, not only would adding the stud walls reduce corridor and classroom space, it would generate the associated costs of removing or replacing items such as chalkboards, lockers, shelving, artwork and cabling.

Conventional wisdom presents obstacles for solving this problem. The cavity between the preexisting walls typically is not easily accessible and some times is enclosed even from the top. The cavity itself usually contains dust, dirt or other contaminants on the wall surfaces which are difficult to clean.

The present invention is directed toward new and non-obvious aspects of methods for retrofitting preexisting wall structures to better resist damage caused by seismic or other forces, as set forth in the claims below.

BRIEF DESCRIPTION OF DRAWINGS

FIG. 2A shows the positioning of a nozzle before adhesive material is introduced into the cavity of the wall structure. FIG. 2B shows the wall structure after an initial layer of an adhesive material has been formed in the cavity. FIG. 2C shows the wall structure after the cavity has been filled with plural layers of the adhesive material.

DETAILED DESCRIPTION

Figure 1:
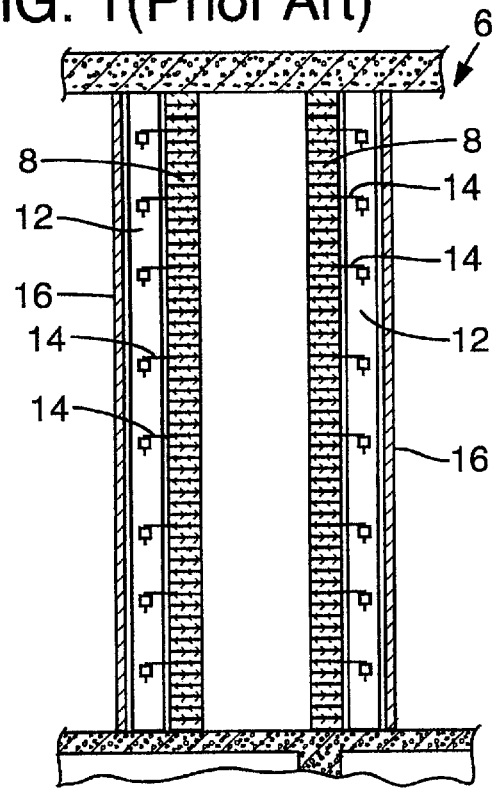
FIG. 1(Prior Art)
FIG. 1 is a cross sectional view of a preexisting double wall structure that is retrofitted with metal stud walls according to a known method.

The present invention seeks to overcome the problems of the prior art by providing an improved method for strengthening preexisting wall structures. The present invention seeks to provide a method and structure for reinforcing preexisting walls which is not labor intensive, has a relatively low construction cost and preferably does not sacrifice usable building space.

According to one embodiment, a method for retrofitting a double wall structure having at least one preexisting wall portion comprises introducing successive layers of a foamable, adhesive material as necessary to fill the cavity between the two wall portions. The amount of adhesive material in each layer is such that the expansion force of the adhesive material does not exceed the lateral strength of the wall portions. The layer of adhesive material is allowed to substantially cure, after which at least one additional layer of adhesive material typically is formed on top of the previously formed layer. The layering process is then repeated until the cavity is filled with plural layers of adhesive material bonding together the wall portions such that the strength of the preexisting wall is increased to more effectively resist seismic activity. The amount of adhesive material used to form each additional layer is substantially the same amount that is used for the initial, bottommost layer.

If needed, a camera may be used to provide a visual image of the interior of the cavity as the layers are being formed. A light source may also be provided to illuminate the interior of the cavity.

According to another embodiment, a method for retrofitting a preexisting single wall comprises mounting plural, horizontally spaced, vertically extending metal studs to the floor and ceiling adjacent to one of the surfaces of the preexisting wall. An outer form is mounted to the metal studs so as to form a cavity between the preexisting wall and the outer form. Layers of a foamable, adhesive material are introduced successively to fill the cavity. The layer of adhesive material is allowed to substantially cure, after which at least one additional layer of adhesive material is formed on top of the previously formed layer. The layering process is then repeated until the cavity is filled with plural layers of adhesive material, bonding together the preexisting wall and the outer form to strengthen the preexisting wall.

According to yet another embodiment, a method for strengthening a wall comprises spacing an inner form, or sheathing layer, from one surface of the wall so as to define a cavity therebetween. A plurality of structural members are positioned outside of the cavity so as to support the inner form. In one specific implementation, the structural members comprise horizontally spaced, vertically extending wooden or metal studs, which can be mounted to the floor and the ceiling adjacent the inner form.

A foamable, adhesive material is introduced into the cavity to bond together the inner form and the wall. Desirably, although not necessarily, the adhesive material is introduced into the cavity as successively formed layers. Each layer desirably is allowed to substantially cure before the next uppermost layer is added to the previously formed layer. If desired, a camera may be used to provide a visual image of the interior of the cavity as adhesive material is introduced into the cavity. A light source may also be provided to illuminate the interior of the cavity.

Finally, an optional outer form may be positioned adjacent to the structural members opposite the sheathing layer to cover the structural members. The outer form desirably comprises a building material conventionally used to form the interior walls of a building, such as wallboard. In an alternative approach, an outer form is not used and the structural members are left exposed.

According to another embodiment, a reinforced wall structure comprises a wall, which may comprise a preexisting wall or a newly constructed wall, and a sheathing layer spaced from the wall so as to define a cavity therebetween. The sheathing layer has first and second major surfaces, with one of the first and second major surfaces serving as an interior surface of the cavity. A plurality of structural members are positioned adjacent to the other major surface of the sheathing layer outside of the cavity. An adhesive material is disposed in the cavity to bond together the wall and the sheathing layer. An outer wall, such as conventional wallboard, may be used to cover the exposed structural members.

Figure 2C:
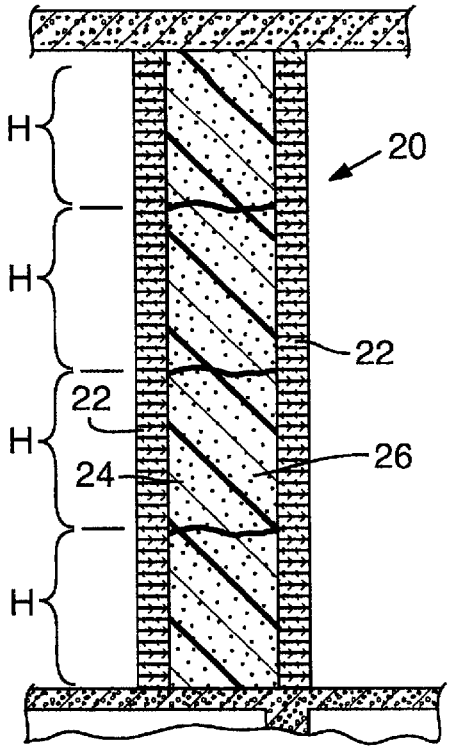
FIGS. 2A–2C are cross sectional views illustrating a method for retrofitting a preexisting double wall structure according to the invention.
Figure 2A:
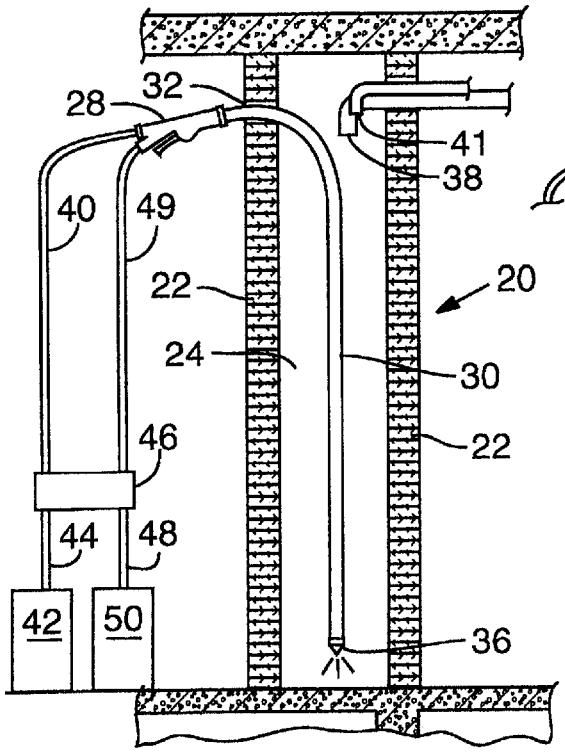
Figure 2B:
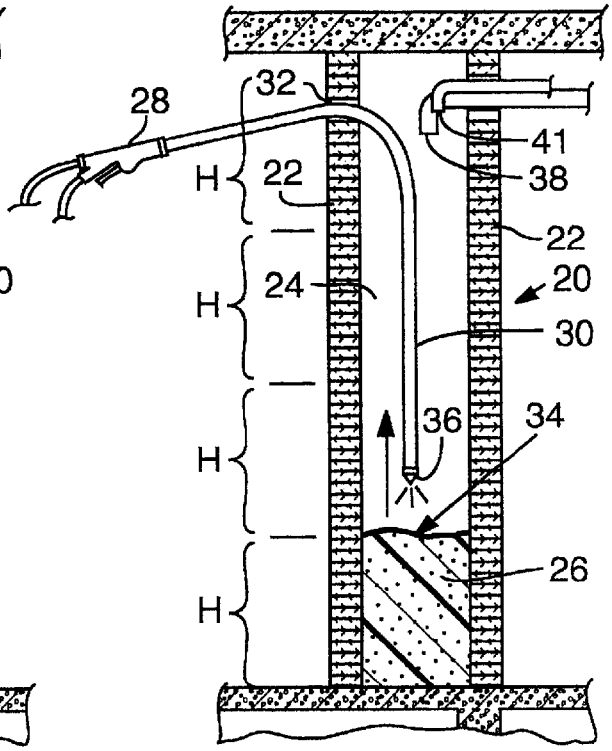

More specifically, and with reference to FIGS. 2A–2C, there is shown a method for retrofitting a preexisting double wall structure 20 according to one embodiment of the invention. The double wall structure 20 includes first and second wall portions 22 horizontally spaced to form a cavity 24 therebetween. In the illustrated embodiment, the wall portions 22 are brick walls, although it is to be understood that the method can be used to retrofit walls of any type of construction to which the cavity filling material will adhere. For example, the method may be applied to cement or concrete walls made of either masonry construction (i.e., blocks joined by mortar) or poured construction; clay tile walls; stone or rock walls; and walls made from other suitable materials, such as earth, adobe, compositions which are cement-like but may not be within a strict definition of the term cement, and the like. Also, the wall portions 22 may contain an internal structure, such as a wooden frame or steel reinforcing bars.

According to the present embodiment, plural layers of a foamable, adhesive material 26 are formed in the cavity 24 to bond together the wall portions 22, thereby providing a more integral construction. Desirably, the adhesive material 26 has the following characteristics: high adhesion to provide a strong bond between the wall portions 22; high compressive, tensile, and shear strength; and low expansion. The adhesive material 26 also should be sufficiently elastic to adsorb energy transmitted to the wall structure 20 caused by seismic activity, have a minimal set up or cure time, and produce minimal off gases harmful to those handling the adhesive material. The adhesive material 26 also may be selected to provide some measure of waterproofing for the wall structure to which the adhesive material is applied. Some examples of adhesive material that can be used include, without limitation, open or closed cell polyurethane foam, or other suitable materials. Closed cell foams are most desirable in that they are substantially impervious to water. A suitable polyurethane foam is the HSF-118 closed cell polyurethane foam manufactured by Hydroseal Polymers, Inc. of Riverside, Calif. The adhesive material 26 desirably has a density from about 1 lb./ft$^3$ to 10 lbs./ft$^3$, and even more desirably from about 2 lbs./ft$^3$ to 10 lbs./ft$^3$.

With reference to FIG. 2A, the adhesive material 26 is formed by mixing a resin base material stored in a container 42 with a conventional activating agent stored in a container 50. In one example, the base material and blowing agent are mixed in a one-to-one ratio. To form a polyurethane foam, such as described above, the base material would be a polyurethane resin. The base material may contain surfactants, fire retardants, a blowing agent and other additives. The density of the adhesive material 26 introduced into the cavity 24 can be varied by starting with a base material of a different formulation, typically by varying the amount of blowing agent in the formulation.

Pumps (not shown) in containers 42 and 50 pump the resin base material and activating agent, respectively, through hoses 44 and 48 into a proportioning unit 46. The proportioning unit 46 pumps the base material and the activating agent at about 1000 psi through hoses 40 and 49, respectively, to a spray gun 28 wherein the base material is mixed with the activating agent. The proportioning unit 46 and the hoses 44, 48, 40 and 49 preferably have heating coils to preheat the base material and activating agent to about 120° F. When the materials mix in the spray gun 28, the activating agent triggers an exothermic chemical reaction, the product of which is the adhesive foam material 26 typically having an initial temperature of about 140° F. During this early exothermic stage, the foam is in a viscous seam-like state and can be poured into the cavity. Once in the cavity the foam flows and expands to fill the cavity.

More specifically, the foam enters the cavity through a nozzle 30 inserted through a longitudinally extending slot 32 formed in one of the wall portions 22 to introduce adhesive material into the cavity 24 (as shown in FIGS. 2A and 2B). If needed, a camera 38, such as a fiber optic camera, may be inserted through an aperture defined in one of the wall portions 22 to provide a visual image of the cavity 24 on a monitor or television screen (not shown) outside the wall structure 20. A light source 41 may be inserted through another aperture defined in one of the wall portions 22 to illuminate the cavity, or alternatively, the camera 38 may be provided with its own light source (not shown). Of course, if the top of the double wall structure is open, the adhesive material 26 can be introduced through the open top of the wall structure and the camera may not be necessary.

The formation of layers of adhesive material 26 within the cavity 24 may be accomplished in the following manner. As shown in FIG. 2A, the end 36 of the nozzle 30 is desirably positioned at a point proximate the bottom of the cavity 24 to ensure an even layer of adhesive material is formed on the bottom of the cavity 24. The adhesive material 26 is sprayed on the bottom of the cavity 24 as the nozzle 30 is moved longitudinally of the cavity (i.e., perpendicular to the plane of the page) so as to form a bottommost layer 34 of adhesive material 26 having a height H after the adhesive material has expanded (as shown in FIG. 2B). The camera 38 and light source 41 may be removed from their respective apertures and inserted into different apertures along the length of the cavity 24 so as to follow the gun 28/nozzle 30 as the layer of adhesive material is being formed. In this manner the "pour area" can be kept in view by the operator.

Since the adhesive material 26 expands to some extent when expelled from the nozzles as it cures, the amount of adhesive material 26 used to form layer 34 should be such that the expansion force of the adhesive material does not exceed the lateral strength of the wall portions 22 and thereby damage the wall portions. It will be appreciated that the adhesive material is free to expand upwardly with relatively little resistance, lessening the outward lateral load exerted on the wall portions by the adhesive material. However, if an excessive amount of adhesive material is introduced into a short section of the cavity over a relatively short duration, the weight of the adhesive material can reduce its ability to expand upwardly and cause excessive expansion forces to be applied laterally outwardly to walls. The rate at which material can be introduced into a given section of the cavity of course will depend on a number of factors including the width of the cavity, rate of expansion of the material as it contacts the air, density of the material, wall strength, and cure time.

After the adhesive material is sprayed into the cavity to form the bottommost layer 34, the end 36 of the nozzle 30 is raised a sufficient distance so as to avoid contact with the expanding adhesive material, which is allowed to cure before another layer of adhesive material is formed on the bottommost layer 34. Preferably, the adhesive material is cured until it expands at only a minimal rate (e.g., the adhesive material has expanded to about 99 percent of its expanded state), or more even preferably, to a point where the adhesive material no longer expands. The cure time is a function of the foam density. For example, the cure time for a foam density of 2 lbs./ft$^3$ is about 4 minutes while the cure time for a foam density of 10 lbs./ft$^3$ may be longer. Once the adhesive material has substantially cured, the end of the nozzle 30 is positioned at a point just above the previously formed, bottommost layer 34 and adhesive material is sprayed on top of the bottommost layer 34 as the nozzle 30 is moved longitudinally of the cavity so as to form an additional layer of adhesive material. The layering process is then repeated until the cavity 24 is filled with layers having substantially the same height H (as illustrated in FIG. 2C).

As explained above with reference to forming the bottommost layer 34, the amount of adhesive material used to form each additional layer within the cavity 24 also should be an amount that does not generate excessive lateral expansion forces that could damage the wall portions 22. Using substantially the same amount of adhesive material for each additional layer as was used to form the bottommost layer 34 should ensure that the expansion forces do not exceed the lateral strength of the wall portions.

When reinforcing clay tile walls, it has been found that for certain applications the height H of each layer should be about 24 inches for a polyurethane foam having a density of about 2 lbs./ft$^3$. For a polyurethane foam having a density of about 10 lbs./ft$^3$ one would expect the preferred layer height H to be less, such as 12 to 16 inches, due to the added weight of the foam.

In an alternative embodiment to the method described above, the cavity 24 of the double wall structure 20 may be completely filled with an adhesive material 26 without forming successive layers, as described above, if the wall portions 22 are strong enough to withstand the expansion forces of the adhesive material 26 injected into the cavity 24 in such a manner. This may be the case, for example, if the wall portions are not particularly high.

The layers of adhesive material 26 bond together the wall portions 22 to reinforce and strengthen the wall portions 22. Surprisingly, the adhesive material 26 will adhere to the inside surfaces of the wall portions 22, regardless of any imperfections, dirt, dust, or other contaminates on those surfaces. Accordingly, cleaning and/or preparation of the inside surfaces of the wall portions 22 is not required prior to forming the layers of adhesive material in the cavity 24.

The invention enjoys several advantages over known methods for retrofitting preexisting wall structures. First, since expensive hardware, such as metal studs and masonry ties, is not required, the material costs for upgrading a building are substantially reduced. Additionally, labor costs are reduced because the method can be accomplished in significantly less time than that required for a conventional method. Moreover, the interior space of a building that is retrofitted according to the present method is not affected and items supported on or located near the inner walls of the building do not have to be disturbed, as is the case when using conventional bracing or metal stud walls. Finally, the invention has been found to be particularly advantageous in retrofitting certain masonry walls, such as clay tile walls, which are especially susceptible to failure even in the event of a minor earthquake. In such cases, the adhesive material bonds together the clay tile walls to more effectively resist cracking or complete collapse of the clay tile walls should an earthquake occur.

Figure 3:
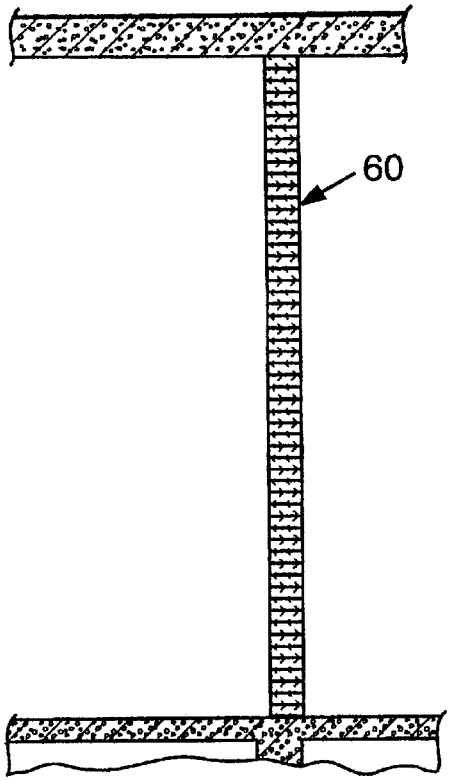
FIG. 3 is a cross sectional view of a preexisting single wall structure without seismic reinforcements.
Figure 5:
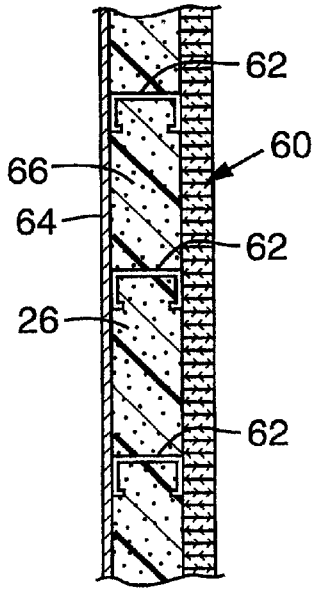
FIG. 5 is a cross sectional view of the wall structure of FIG. 5 taken along line 6—6.

According to another embodiment of the invention, a method for retrofitting a preexisting single wall structure 60 (shown in FIG. 3 without any seismic reinforcements) is provided. In this method, plural, horizontally spaced, vertically extending metal studs 62 are mounted to the floor and ceiling, in close, preferably abutting, relationship to the wall 60 (as shown in FIG. 5). An outer form or wall 64 is mounted to the metal studs so as to form a cavity 66 between the preexisting wall 60 and the outer form 64. In this sense, the preexisting wall 60 and the outer form 64 together form a double wall structure having a single preexisting wall portion. The outer form 64 may comprise, for example, plywood, composition board, or metal siding.

Figure 4:
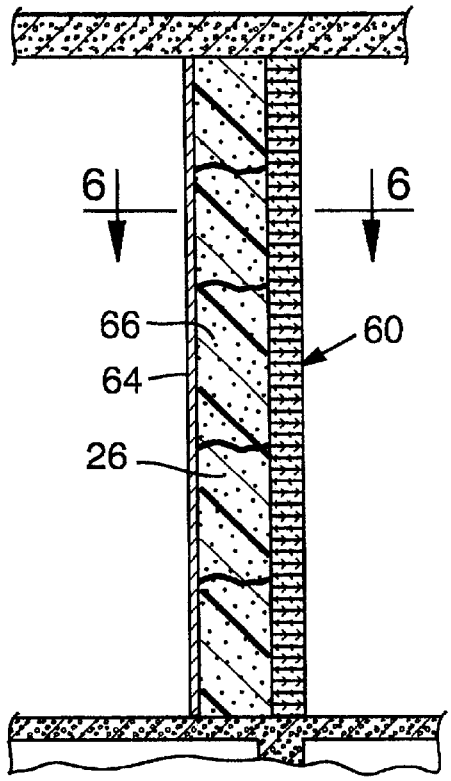
FIG. 4 is a cross sectional view of the wall structure of FIG. 4 after it has been retrofitted according to the invention.

As shown in FIG. 4, plural layers of a foamable, adhesive material 26 are formed in the cavity 66 to bond together the preexisting wall 60 and the outer form 64 so that the preexisting wall 60 is strong enough to better resist seismic forces. The adhesive material also bonds the metal studs 62 to the preexisting wall 60. Consequently, Helifix screws or equivalent masonry ties are not required to secure the metal studs 62 to the wall 60.

In a working embodiment, the layers of adhesive material 26 are formed in the cavity 66 in the manner described above with respect to the double wall structure 40 shown in FIGS. 2A–2C. However, it should be understood that the layers of adhesive material may be formed in any suitable manner, or alternatively, the cavity 66 may be completely filled with an adhesive material without forming successive layers if the wall 60 and outer form 64 are strong enough to withstand the expansion forces of the adhesive material injected into the cavity in such a manner.

Figure 6:
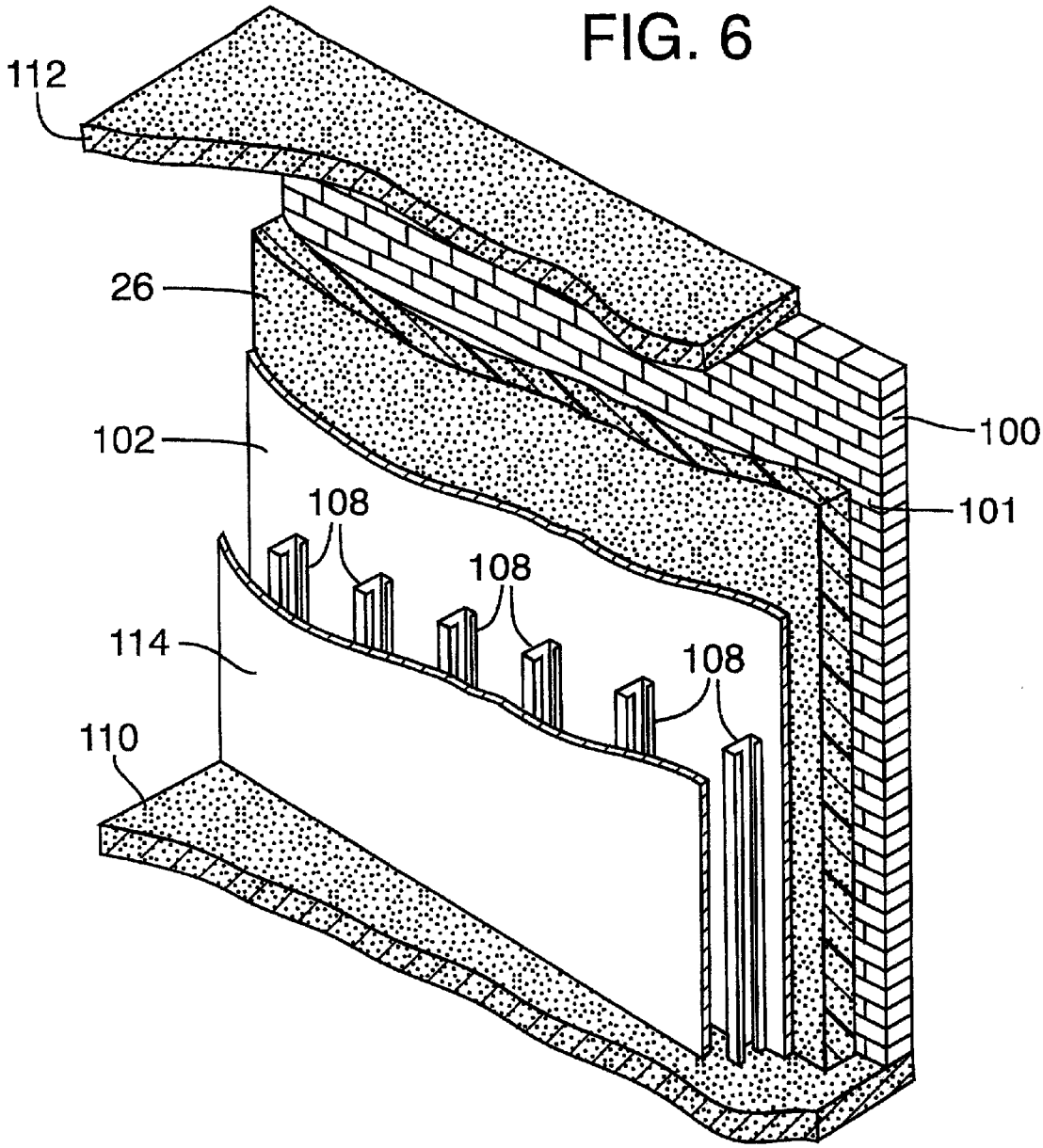
FIG. 6 is a perspective view of a preexisting single wall structure retrofitted with seismic reinforcements according to another embodiment, with portions of the outer form, the structural members, the sheathing layer, and the adhesive material broken away for clarity.
Figure 7:
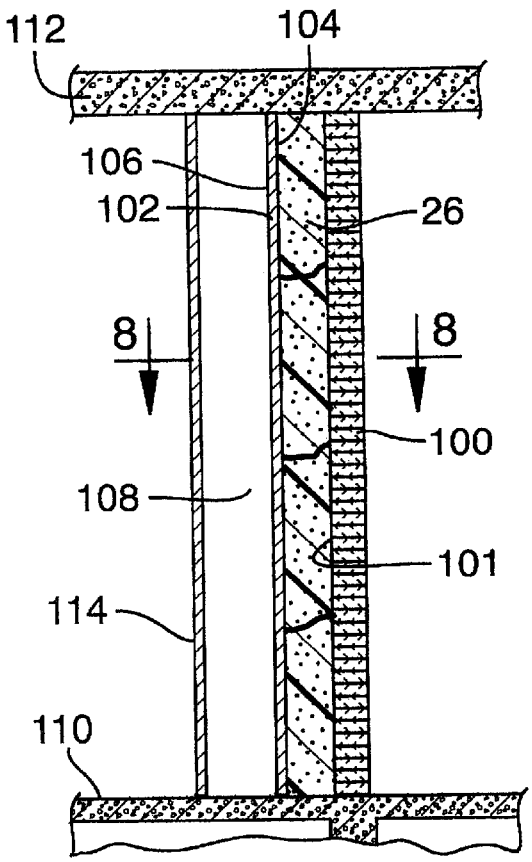
FIG. 7 is a vertical cross sectional view of the wall structure of FIG. 6.
Figure 8:
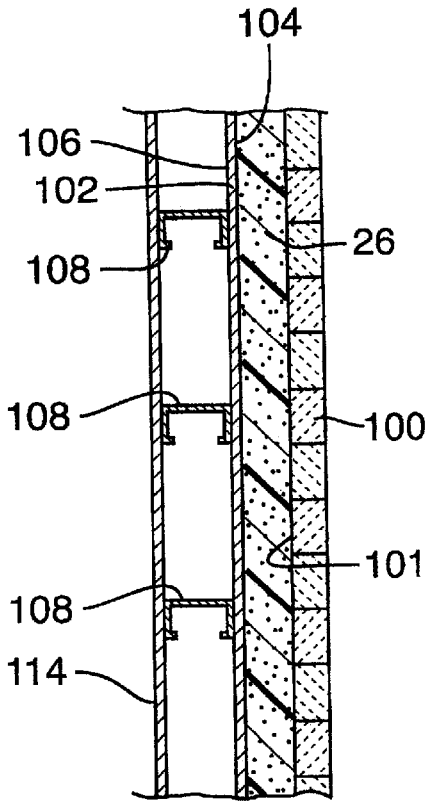
FIG. 8 is a horizontal cross sectional view of the wall structure of FIG. 7 taken along line 8—8 of FIG. 7.

FIGS. 6–8, illustrate another approach for strengthening a single wall 100. This approach (as well as the other strengthening methods described herein) has particular applicability for strengthening a preexisting wall structure, although it may also be used to strengthen wall structures in new construction. As shown, an inner form, or sheathing layer 102, having first and second major surfaces 104, 106, respectively, is spaced from a surface 101 of the wall 100 so as to define a cavity therebetween for receiving adhesive material 26. Although not required, spacers (not shown), having a thickness equal to the desired width of the cavity, may be positioned along the surface 101 of the wall 100 to facilitate positioning of the sheathing layer 102. Desirably, the sheathing layer 102 is selected to have sufficient strength to withstand the expansion forces of adhesive material 26 introduced into the cavity. Without limitation, the sheathing layer 102 may comprise, for example, plywood, composition board, OSB, hardy board, metal siding, or other forms of structural boarding made of any of various materials.

Suitable structural members are positioned adjacent the second major surface 106 of the sheathing layer 102 outside of the cavity for supporting the sheathing layer 102. In the illustrated embodiment, for example, the structural members comprise a plurality of horizontally spaced, vertically extending metal studs 108, which can be mounted to the floor 110 and the ceiling 112 adjacent the sheathing layer 102. The sheathing layer 102 may be mounted to the studs 108 with screws or other suitable fasteners. The metal studs 108 desirably have a C-shaped cross sectional, although studs having other cross sectional shapes also may be used. For example, studs having I-shaped cross sections (i.e., I-beams) can be used. In addition, other forms of structural members also may be used. For example, conventional wooden studs may be used in lieu of metal studs. Further, it is not a requirement that the structural members be oriented in a vertically upright position. For example, the structural members may extend horizontally or diagonally across the second major surface 106 of the sheathing layer 102.

Like the embodiment of FIGS. 4 and 5, plural layers of the foamable, adhesive material 26 desirably are formed in the cavity to bond together the wall 100 and the sheathing layer 102 so that the wall 100 is strong enough to better resist seismic forces. An elongated slot (not shown) may be provided in the sheathing layer 102, through which the nozzle 30 of a spray gun 28 (FIGS. 2A and 2B) may be inserted for introducing the adhesive material 26 into the cavity. Desirably, the layers of adhesive material 26 are formed in the cavity in the manner described above with respect to the double wall structure 40 shown in FIGS. 2A–2C. However, it should be understood that the layers of adhesive material may be formed in any suitable manner, or alternatively, the cavity may be completely filled with an adhesive material without forming successive layers if the wall 100 and the sheathing layer 102 are strong enough to withstand the expansion forces of the adhesive material injected into the cavity in such a manner. Still alternatively, in some applications, it may be sufficient to partially fill, rather than completely fill, the cavity with adhesive material. This may be the case, for example, if the wall 100 is not particularly brittle or weak but nonetheless needs to be upgraded to better resist seismic or other forces.

If desired, as described above in connection with FIGS. 2A and 2B, a camera (not shown) may be used to provide a visual image of the interior of the cavity as the adhesive material 26 is introduced into the cavity. A light source (not shown) may also be provided to illuminate the interior of the cavity.

An optional outer form, or wall 114 may be positioned adjacent the studs 108, opposite the sheathing layer 102, to cover the exposed studs 108 and provide a convention wall surface. The outer form 114 may be mounted to the studs 108 with screws or other suitable fasteners. The outer form 114 may comprise any suitable material. For example, in applications where the wall 100 is strengthened from the interior of the building (i.e., the adhesive material 26, the sheathing layer 102, and the studs 108 are added to the interior surface of the wall 100), then building material conventionally used to form the interior walls of a building, such as wallboard (also called drywall or sheet rock), may be used to cover the studs 108. However, other conventional building materials, such as plywood, composition board, OSB, hardy board, or metal siding or any of other various materials also may be used.

The strengthening method of FIGS. 6–8 provides additional advantages when compared to the method of FIGS. 4 and 5. By positioning the studs 108 outside of the cavity in the method of FIGS. 6–8, rather than inside of the cavity as in the method of FIGS. 4 and 5, the width of the cavity can be reduced. Thus, less adhesive material 26 is required to fill the cavity in FIGS. 6–8.

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

We claim:

1. A method or strengthening a double wall structure having first and second spaced apart wall portions with a cavity therebetween wherein at least one of the wall portions is a preexisting wall, the method comprising:

providing a camera to provide a visual image of the interior of the cavity;

providing a light source to illuminate the interior of the cavity;

forming a layer of a foamable, adhesive material in the cavity wherein the amount of adhesive material in the layer is such that the expansion force of the adhesive material does not exceed the lateral strength of the first and second wall portions;

curing the layer of adhesive material;

forming at least one addition layer of adhesive material on top of the previously formed layer of adhesive material after the previously formed layer has cured, the height of the additional layer being substantially the same as the previously formed layer after expansion; and repeating the act of forming the additional layer until the cavity is filled with layers of adhesive material bonding together the wall portions such that the strength of the preexisting wall is increased to more effectively resist lateral and vibration induced loads.

2. The method of claim 1 wherein at least one of the first and second wall portions is a preexisting masonry wall.

3. The method of claim 1 wherein at least one of the first and second wall portions is a preexisting clay tile wall.

4. The method of claim 1 wherein metal studs are positioned in the cavity to reinforce the preexisting wall, the studs being secured to a floor and ceiling adjacent the preexisting wall.

5. The method of claim 1 wherein the adhesive material is polyurethane.

6. The method of claim 5 wherein the density of the polyurethane is about 2 lbs./ft$^3$.

7. The method of claim 1 wherein the adhesive material is injected into the cavity to form each layer with a nozzle that is inserted through an aperture in one of the wall portions.

8. A method for strengthening a preexisting double wall structure wherein the wall structure comprises first and second preexisting clay tile wall portions with a cavity therebetween, the method comprising:

providing a camera to provide a visual image of the interior of the cavity;

forming a layer of a foamable, adhesive material in the cavity wherein the amount of adhesive material in the layer is such that the expansion force of the adhesive material does not exceed the lateral strength of the first and second wall portions;

curing the layer of the adhesive material;

forming at least one additional layer of adhesive material on top of the previously formed layer of adhesive material after it has cured; and repeating the act of forming the additional layer until the cavity is filled with layers of adhesive material bonding together the preexisting wall portions so that the strength of the wall portions is increased to more effectively resist lateral and vibration induced loads.

9. The method of claim 8 wherein each layer is substantially the same height after expansion.

10. The method of claim 8 wherein the adhesive material is injected into the cavity to form each layer with a nozzle that is inserted through an aperture in one of the wall portions.

11. The method of claim 8 wherein curing the layers of adhesive material comprises expanding the layer of adhesive material.

12. The method of claim 8 further comprising providing a light source to illuminate the interior of the cavity.

13. A method for strengthening a preexisting double wall structure wherein the wall structure comprises first and second preexisting wall portions with a cavity therebetween, the method comprising:

inserting a camera through an aperture in one of the wall portions to provide a visual image of the interior of the cavity;

positioning a nozzle for spraying a foamable, adhesive material at a point proximate the bottom of the cavity and spraying adhesive material with the nozzle into the cavity while moving the nozzle longitudinally of the cavity so as to form a layer of adhesive material wherein the amount of adhesive material sprayed into the cavity is such that the expansion force of the adhesive material does not exceed the lateral strength of the first and second wall portions;

positioning the nozzle at a point just above the expanded, previously formed layer and spraying adhesive material on top of the previously formed layer while moving the nozzle longitudinally of the cavity so as to form another layer of adhesive material having substantially the same height as the previously formed layer; and repeating the act of positioning the nozzle at a point just above the expanded, previously formed layer until the cavity is filled with layers of adhesive material bonding together the preexisting wall portions.

14. The method of claim 13 wherein the adhesive material comprises polyurethane having a density of about 2 lbs./ft$^3$.

15. The method of claim 13 wherein the nozzle is inserted through an aperture in one of the wall portions.

16. The method of claim 13 wherein a light source is inserted through another aperture in one of the wall portions to illuminate the interior of the cavity.

17. A method for strengthening a preexisting wall:

positioning plural, horizontally spaced, vertically extending metal studs adjacent to one of the surfaces of the preexisting wall;

mounting an outer form to the metal studs to form a cavity between the preexisting wall and the outer form, such that the metal studs are within the cavity;

forming a layer of a foamable, adhesive material in the cavity;

allowing the layer of adhesive material to substantially cure;

forming at least one additional layer of adhesive material on top of the previously formed layer of adhesive material after it has cured; and repeating the act of forming the additional layer until the cavity is filled with layers of adhesive material bonding together the preexisting wall and the outer form such that the strength of the preexisting wall is increased to more effectively resist seismically induced loads.

18. The method of claim 17 wherein the adhesive material comprises polyurethane having a density of about 2 lbs./ft$^3$.

19. The method of claim 17 further comprising mounting the metal studs to the floor and ceiling adjacent the wall.

20. The method of claim 17 further comprising providing a camera to provide a visual image of the interior of the cavity.

21. The method of claim 20 further comprising providing a light source to illuminate the interior of the cavity.

22. A method for strengthening a wall:

spacing an inner form from one surface of the wall so as to define a cavity therebetween;

positioning a plurality of structural members outside of the cavity so as to support the inner form; and introducing a foamable, adhesive material into the cavity to bond together the inner form and the wall.

23. The method of claim 22, further comprising positioning an outer form adjacent to the structural members opposite the inner form.

24. The method of claim 22, wherein introducing a foamable, adhesive material into the cavity comprises forming a layer of a foamable, adhesive material in the cavity, allowing the layer of adhesive material to substantially cure, forming at least one additional layer of adhesive material on top of the previously formed layer of adhesive material after it has cured, and repeating the act of forming the additional layer until the cavity is filled with layers of adhesive material bonding together the wall and the inner form.

25. The method of claim 24, wherein each layer of adhesive material is substantially the same height after expansion.

26. The method of claim 22, wherein the wall is secured to the inner form by the adhesive material without any mechanical fasteners interposed between and secured to the wall and the inner form.

27. The method of claim 22, wherein the structural members comprise plural, horizontally spaced, vertically extending metal studs mounted to a floor and ceiling adjacent the inner form.

28. The method of claim 22, wherein the wall comprises a preexisting structural wall and the adhesive material bonds together the inner form and the preexisting wall such that the strength of the preexisting wall is increased to more effectively resist seismically induced loads.

29. The method of claim 22, further comprising providing a camera to provide a visual image of the cavity.

30. The method of claim 29, further comprising providing a light source to illuminate the cavity.

31. A method for strengthening a previously constructed structural wall:

placing a sheathing layer at a position spaced from the wall so as to define a cavity between the sheathing layer and the wall;

positioning a plurality of structural members outside of the cavity such that the structural members support the sheathing layer;

introducing a foamable, adhesive material into the cavity to bond together the wall and the sheathing layer such that the strength of the wall is increased to better resist seismically induced loads; and covering the structural members with an outer form.

32. The method of claim 31, wherein introducing a foamable, adhesive material into the cavity comprises forming a layer of a foamable, adhesive material in the cavity, allowing the layer of adhesive material to substantially cure, forming at least one additional layer of adhesive material on top of the previously formed layer of adhesive material after it has cured, and repeating the act of forming the additional layer until the cavity is filled with layers of adhesive material bonding together the wall and the sheathing layer.

33. The method of claim 32, wherein curing the layers of adhesive material comprises expanding the layers of adhesive material.

34. The method of claim 31, wherein introducing a foamable, adhesive material into the cavity comprises:

positioning a nozzle for spraying a foamable, adhesive material at a point proximate the bottom of the cavity and spraying adhesive material with the nozzle into the cavity while moving the nozzle longitudinally of the cavity so as to form a layer of adhesive material and wherein the amount of adhesive material sprayed into the cavity is such that the expansion force of the adhesive material does not exceed the lateral strength of the wall;

positioning the nozzle at a point just above the expanded, previously formed layer and spraying adhesive material on top of the previously formed layer while moving the nozzle longitudinally of the cavity so as to form another layer of adhesive material having substantially the same height as the previously formed layer; and repeating the act of positioning the nozzle at a point just above the expanded, previously formed layer until the cavity is filled with layers of adhesive material bonding together the wall and the sheathing layer.

35. The method of claim 31, wherein the adhesive material comprises polyurethane.

36. The method of claim 31, wherein the cavity is partially filled with adhesive material.

37. A wall structure comprising:

a wall;

a sheathing layer having first and second major surfaces, the sheathing layer being spaced from one surface of the wall so as to define a cavity between the first major surface of the sheathing layer and the wall;

a plurality of structural members positioned adjacent to the second major surface of the sheathing layer; and adhesive material disposed in the cavity, the adhesive material bonding together the wall and the sheathing layer.

38. The wall structure of claim 37, further comprising an outer form positioned adjacent to the structural members opposite the sheathing layer.

39. The wall structure of claim 38, wherein the outer form comprises wallboard.

40. The wall structure of claim 37, wherein the adhesive material comprises polyurethane.

41. The wall structure of claim 40, wherein the polyurethane has a density of about 2 lbs./$ft^3$.

42. The wall structure of claim 37, wherein the structural members comprise plural, horizontally spaced, vertically extending metal studs.

43. The wall structure of claim 37, wherein the structural members comprise plural, horizontally spaced, vertically extending wooden studs.

44. The wall structure of claim 37, wherein the adhesive material is substantially impervious to water.

45. The wall structure of claim 37, wherein the structural members are secured to a floor and ceiling adjacent the sheathing layer.

* * * * *

UNITED STATES PATENT AND TRADEMARK OFFICE

CERTIFICATE OF CORRECTION

PATENT NO. : 6,662,516 B2
APPLICATION NO. : 09/990907
DATED : December 16, 2003
INVENTOR(S) : Vandehey et al.

It is certified that error appears in the above-identified patent and that said Letters Patent is hereby corrected as shown below:

In the Specification:

In column 8, line 27, "method or" should be -- method for --.

Signed and Sealed this

Twenty-first Day of August, 2007

JON W. DUDAS
*Director of the United States Patent and Trademark Office*